US006537160B2

(12) United States Patent
Chrystal

(10) Patent No.: US 6,537,160 B2
(45) Date of Patent: Mar. 25, 2003

(54) TRAINING DEVICE

(76) Inventor: W. Jeff Chrystal, 1231 Cobblestone La., Portage, MI (US) 49024

( * ) Notice: Subject to any disclaimer, the term of this patent is extended or adjusted under 35 U.S.C. 154(b) by 0 days.

(21) Appl. No.: 09/858,030

(22) Filed: May 15, 2001

(65) Prior Publication Data

US 2002/0173387 A1 Nov. 21, 2002

(51) Int. Cl.[7] ..... A63B 69/36
(52) U.S. Cl. ..... 473/422; 473/450; 473/213
(58) Field of Search ..... 473/422, 205, 473/207, 212, 213, 450, 458, 464, 59, 62; 24/16 PB; 206/223; 70/16

(56) References Cited

U.S. PATENT DOCUMENTS 2,450,162 A * 9/1948 Promen
4,026,549 A * 5/1977 Gunn
4,124,207 A * 11/1978 Breslow et al.
4,249,401 A * 2/1981 Daleo
4,377,284 A * 3/1983 Okerlin
4,540,173 A * 9/1985 Hopkins, Jr.
5,188,365 A * 2/1993 Picard
5,259,621 A * 11/1993 Keefer
5,443,155 A * 8/1995 Robinson
5,551,086 A * 9/1996 Albanese
5,860,872 A * 1/1999 Vitale
5,938,548 A * 8/1999 Upshaw
6,151,761 A * 11/2000 Thompson

OTHER PUBLICATIONS

"The Band The Original Action Sports Watchband®, CHISCO" catalog code 0700, front and back cover and p. C, dated stamped Aug. 21, 2000 (3 pages).

* cited by examiner

*Primary Examiner*—Paul T. Sewell
*Assistant Examiner*—Nini F. Legesse
(74) *Attorney, Agent, or Firm*—Flynn, Thiel, Boutell & Tanis, P.C.

(57) ABSTRACT

A training device for facilitating an orientation of a performer's hands prior to a performing of a task and includes a pair of bracelets adapted to be worn on the left and right wrists of the performer. Each bracelet includes an annular band and a plurality of tubular rollers rotatable about an axis of the respective annular band to facilitate a movement of the bracelets over the performer's hands while moving onto and off from the performer's wrists. The two bracelets also include a tethering device coupling the bracelets to one another. The invention also relates to the method of performing a task which requires the hands of the performer to be oriented close together so that they can be used in concert followed shortly thereafter by moving one hand independently of the other.

14 Claims, 4 Drawing Sheets

TRAINING DEVICE

FIELD OF THE INVENTION

This invention relates to a training device and, more particularly, to an athletic training device facilitating an orientation of a performer's hands prior to a performing of a task.

BACKGROUND OF THE INVENTION

There are many environments in which it is necessary to keep the hands closely together while performing a given task or while performing at least one part of a given task. In many instances, the performer's hands will not remain closely together during the performing of a task thereby making the quality of the performance less than desirable. This situation is particularly acute in attempting to train youngsters in the art of catching a ball, such as a baseball, softball or a football. Once the task is performed, it is usually necessary to do something with the ball, such as throwing the ball to someone else. Thus, if the hands are somehow tied together, it is difficult to release that securement in time to facilitate a timely further handling of the ball. Thus, there is a need for a device which will facilitate an orientation of a performer's hands closely together during the performance of one task and enabling a quick release of the tied together hands to enable one hand to perform a further task independent of the other.

It is to be understood that while the following disclosure relates to the art of catching a ball, the training device disclosed herein has other uses as well and these other uses are to be embraced within the scope of the invention.

SUMMARY OF THE INVENTION

The objects and purposes of the invention are met by providing a training device for facilitating an orientation of a performer's hands prior to a performing of a task and includes a pair of bracelets adapted to be respectively worn on the left and right wrists of the performer. Each bracelet includes a band having a circumference configured to annularly embrace the selected wrist of the performer and a plurality of tubular rollers each having a hollow interior that loosely receives therein the respective band so that the tubular rollers can rotate about an axis of the respective band to facilitate a movement of the bracelets over the performer's hands while moving onto and off from the performer's wrists. The two bracelets also include a tethering device coupling the bracelets to one another. The invention also relates to the method of performing a task which requires the hands of the performer to be oriented close together so that they can be used in concert followed shortly thereafter by moving one hand independently of the other.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 8:
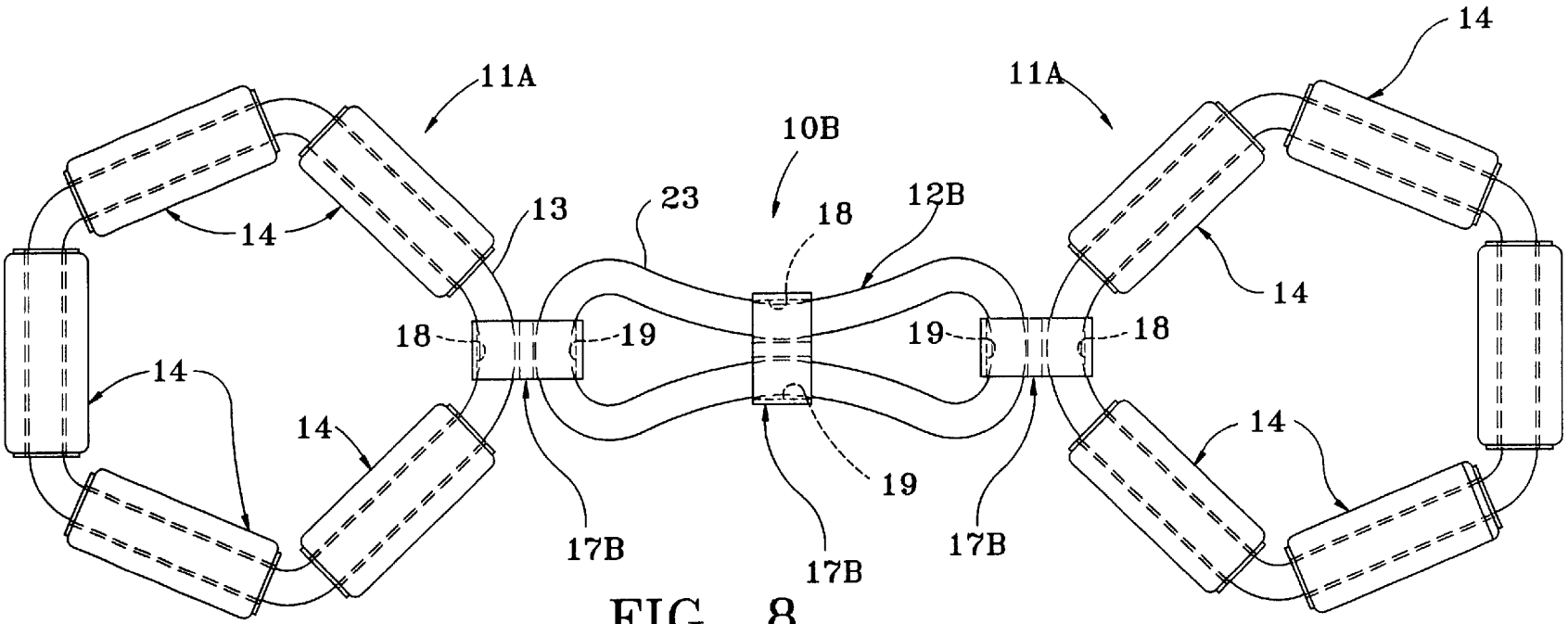
FIG. 8 is a top plan view of a further embodiment of the training device.
Figure 9:
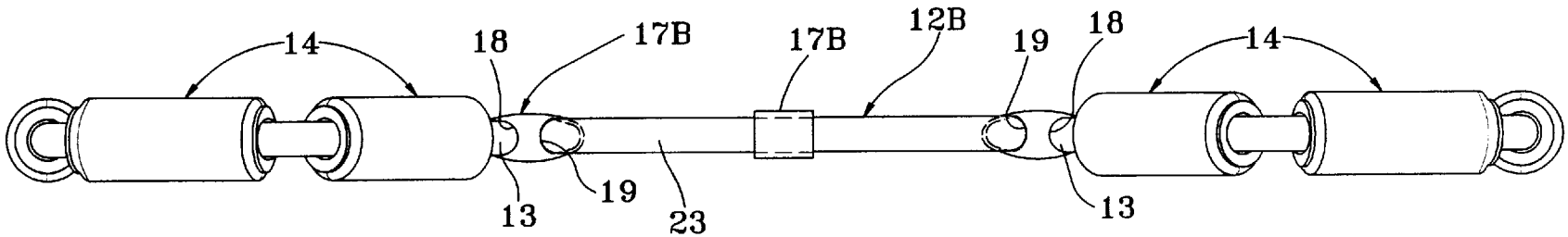
FIG. 9 is a front edge view of FIG. 8.

FIGS. 1–3 and 6 illustrate a first embodiment of a training device 10, FIGS. 4–7 illustrate a second embodiment of a training device 10A and FIGS. 8 and 9 illustrate a third embodiment of the training device 10B. Each training device 10, 10A and 10B has two identical bracelets 11A and 11B interconnected by a tether device 12 (FIG. 1), 12A (FIG. 4) and 12B (FIG. 8). Each embodiment will be described separately as follows.

Figure 1:
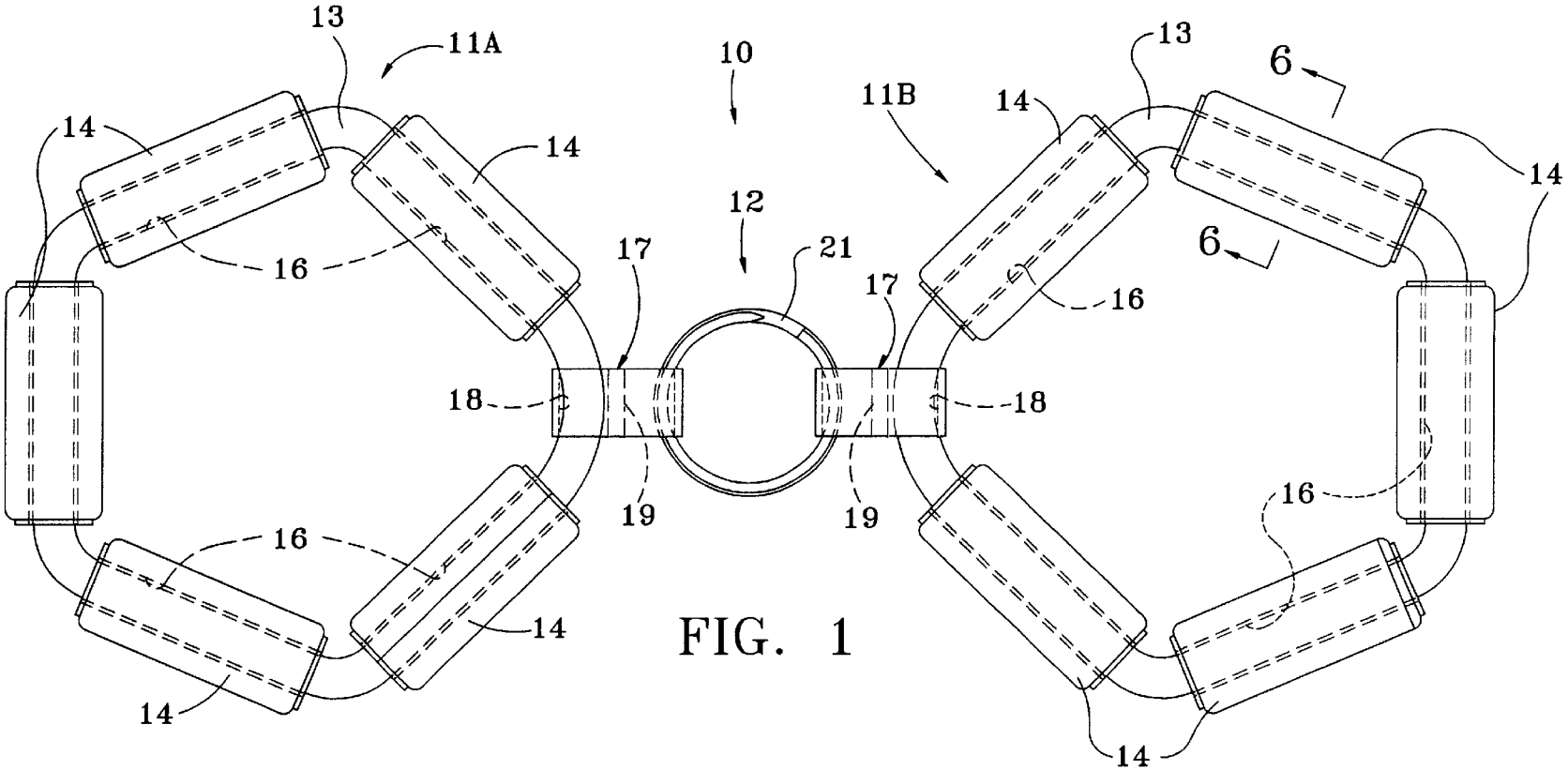
FIG. 1 is a top plan view of a training device embodying the invention.
Figure 2:
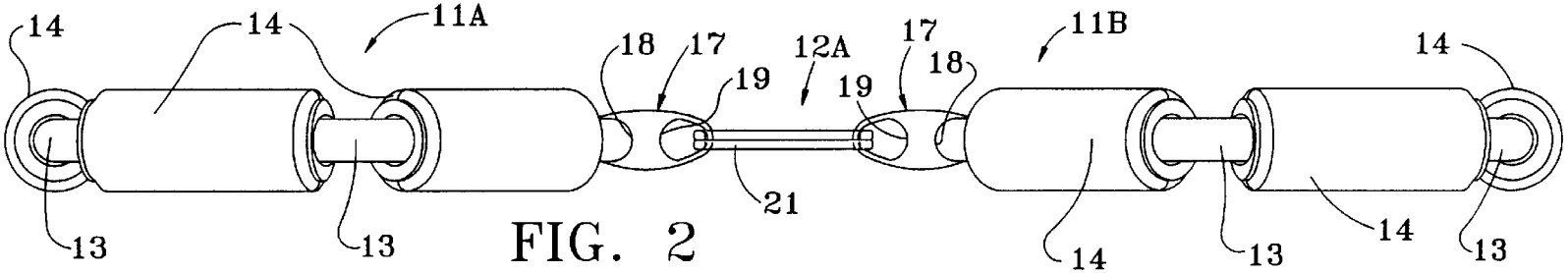
FIG. 2 is an edge view of FIG. 1.
Figure 3:
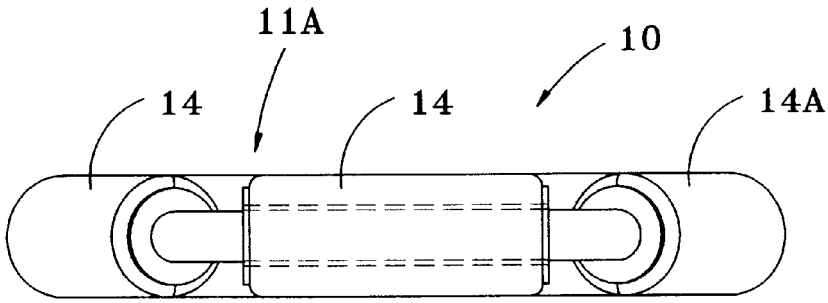
FIG. 3 is a left edge view of FIG. 2.

Referring to the first embodiment of the training device 10 illustrated in FIGS. 1–3 and 6, each of the bracelets 11A and 11B are identical to one another and are composed of a elastic band 13 having thereon a plurality of spaced apart tubular rollers 14 having a hollow interior 16. The hollow interiors 16 receive the elastic band 13 therethrough and with some degree of clearance to enable the rollers 14 to rotate about the axis of the elastic band 13 extending therethrough. A clip 17 is provided and has a pair of holes 18 and 19 extending therethrough. Initially, a strip of the elastic band is cut to a selected length and the ends of the elastic band are received in and adhesively secured inside of one of the holes 18 as illustrated in FIGS. 1 and 2 to form an annular or endless band and the bracelet 11A.

The bracelet 11B is identical to the bracelet 11A and, therefore, a further detailed description thereof is unnecessary. However, and to simplify the disclosure, the reference numerals that have been utilized above to describe the bracelet 11A have been incorporated into the bracelet structure 11B.

A tethering device 12 in the form of an annular ring 21 is provided to connecting the two bracelets 11A and 11B together. A section of the annular ring 21 is received into the respective opening 19 of the respective clip 17 in each of the bracelets 11A and 11B.

Figure 6:
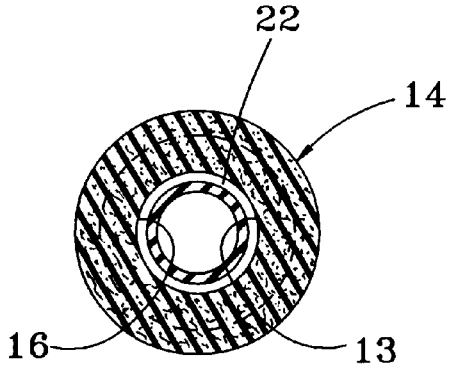
FIG. 6 is a sectional view taken along the line 6—6 of FIG. 1.
Figure 7:
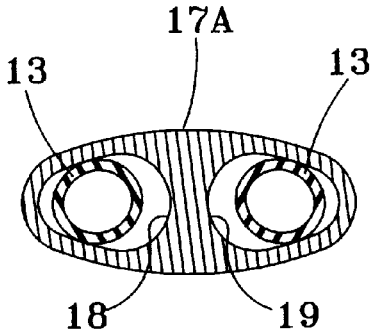
FIG. 7 is a sectional view taken along the line 7—7 of FIG. 4.
Figure 4:
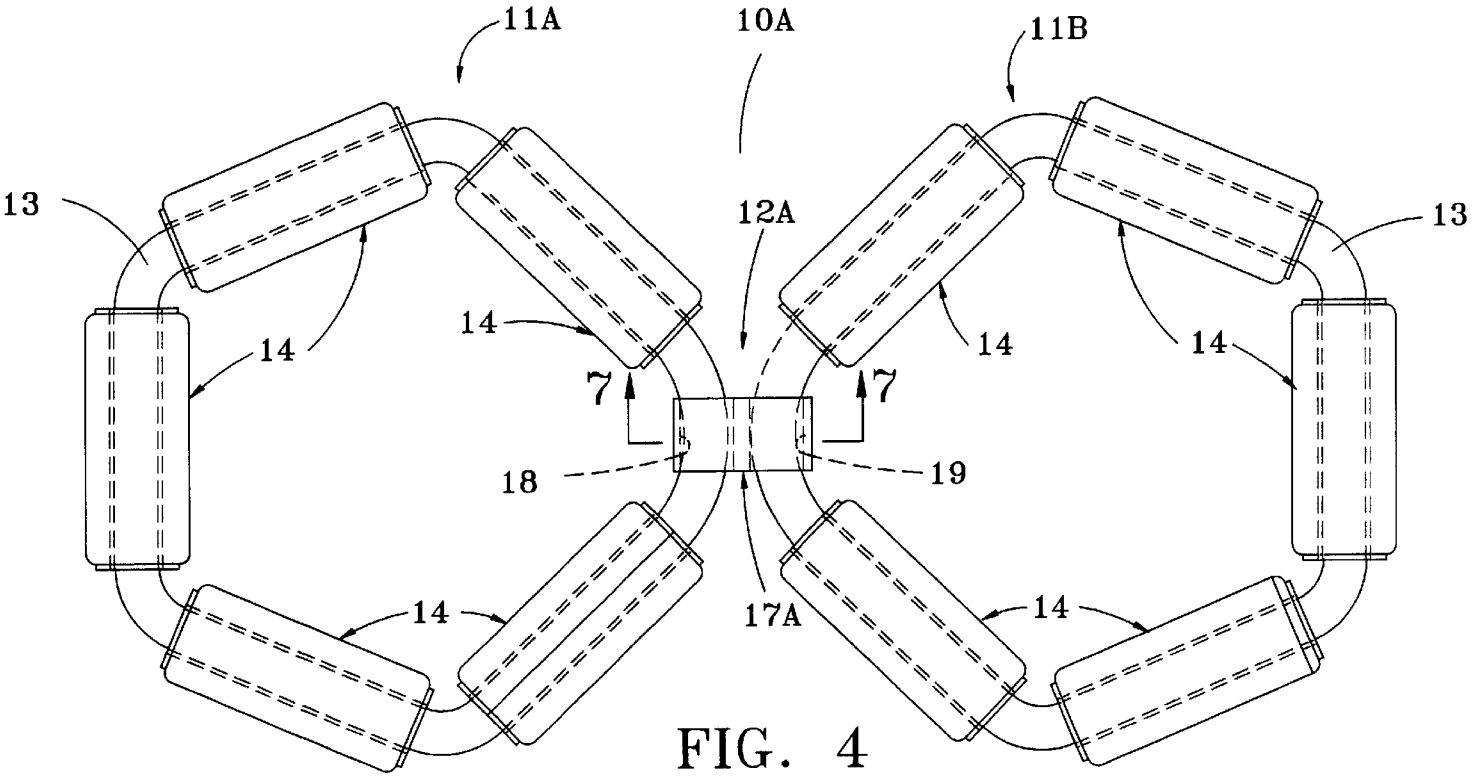
FIG. 4 is a top plan view of an alternate embodiment of the training device.
Figure 5:
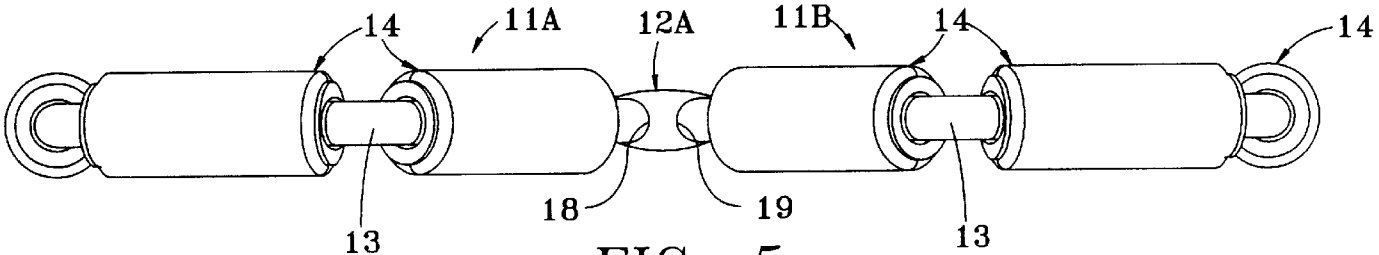
FIG. 5 is a front edge view of FIG. 4.

As is illustrated in FIG. 6, there exists a small clearance space 22 between the outer diameter of the elastic band 13 and the inner diameter of the hollow interior 16 of the cylindrical tubular rollers 14. This clearance 22 facilitates relative rotation between the elastic band 13 and the tubular rollers 14.

FIG. 6 illustrates that the elastic band 13 is tubular in construction. It is within the scope of this invention to make the elastic band 13 of a solid cross sectional configuration. The elastic band is both stretchable and bendable to facilitate an adaptation of each bracelet to a particular wrist size of the person chosen to perform a selected task utilizing this invention. The tubular rollers 14 are also elastic and compressible as well as being bendable in order to accommodate the curved surfaces on the human body.

Referring now to the second embodiment of the training device 10A illustrated in FIGS. 4–7, the two bracelets 11A and 11B are identical to the bracelets described above. Therefore, further detailed discussion about them is unnecessary. However, the same reference numerals that have been used above have been incorporated into the drawings.

The only difference between the first embodiment 10 and the second embodiment 10A of the training devices is the manner in which the two bracelets 11A and 11B are connected together by the modified tethering device 12A. More specifically, the tethering device 12A utilizes only one clip 17A identical to one of the clips 17 in the first embodiment. The elastic band 13 of the bracelet 11A is received in the hole 18 of the modified clip 17A whereas the endless band 13 of the bracelet 11B is received in the hole 19 of the clip 17A. The elastic characteristic of the endless bands 13 of the respective bracelets 11A and 11B facilitate relative movement between the wrists during the performance of a given task and without detracting from the benefits derived by this invention. Furthermore, this embodiment is less expensive due to the elimination of one clip and one ring as described in the first embodiment.

Referring now to the third embodiment of the training device 10B illustrated in FIGS. 8–9, the two bracelets 11A and 11B are identical to the bracelets described above. Therefore, further detailed discussion about them is unnecessary. However, the same reference numerals that have been used above have been incorporated into the drawings.

The only difference between the first embodiment 10 and the third embodiment 10B of the training devices is the manner in which the two bracelets 11A and 11B are connected together by the modified tethering device 12B. More specifically, the tethering device 12B utilizes three clips 17B identical to each of the clips 17 in the first embodiment. The elastic band 13 of the bracelet 11A is received in the hole 18 of the modified clip 17B whereas the endless band 13 of the bracelet 11B is received in the hole 19 of the clip 17B.

The tether 12B also includes an elastic band 23 that is both stretchable and bendable and generally has the same other characteristics of the elastic bands 13. In this embodiment, the elastic bands 13 and 23 are of an identical material. The elastic band is received in the holes 19 of the two clips 17B secured to the elastic bands 13 and in both holes 18 and 19 of the middle clip 17B oriented in between the aforesaid two clips. The middle clip 17B serves to reduce the space that elastic band 23 would occupy if it were not tethered by the middle clip. Initially, a strip of the elastic band 23 is cut to a selected length and the ends of the elastic band are received in and adhesively secured inside of one of the holes 19, for example, of one of the clips 17B.

The elasticity of the band 23 allow some relative movement of the wrists away from each other during use, more so than would be allowed by the elastic bands 13 alone.

Each of the training devices 10, 10A and 10B are used in an identical manner and, therefore, that manner will now be described. In the process of teaching someone to orient their hands in a particular way relative to their body in order to perform a specific task, the training device 10 or 10A or 10B described above is to be utilized. The performer's hands are first inserted into the respective bracelets 11A and 11B so that, for example, the bracelet 11A encircles the left wrist and the bracelet 11B encircles the right wrist. Thereafter, the person chosen to perform a given task is then told to perform it while the training device remains engaged with the wrists' of the performer. In an instance where the task to be performed is to catch a baseball, the performer can perform the task of catching the ball by keeping both of his hands relative close together as encouraged by the training device. Thereafter, and due to the provision of the plurality of tubular rollers 14 on each of the bracelets 11A and 11B, a selected wrist can be removed from one of the bracelets, such as the bracelet 11A encircling the performer's left wrist, to enable the person to thereafter throw the ball with the left hand. Subsequently, the performer can then reinsert the left hand into an through the bracelet 11A to relocate the bracelet 11A in an encircling relation around the left wrist ready to prepare for the next task to be performed. Obviously, a right handed person would remove the bracelet 11B.

The invention enables the quick placement of the bracelets onto the respective wrists as well as the removable thereof from the selected wrist to enable the play of a particular game or to facilitate the performance of other tasks with the wrists unrestrained from one another. The rollers 14 enable the bracelets to move quickly and easily onto and off from the wrists and without injury to the performer's skin.

Although particular preferred embodiments of the invention has been disclosed in detail for illustrative purposes, it will be recognized that variations or modifications of the disclosed apparatus, including the rearrangement of parts, lie within the scope of the present invention.

I claim:

1. A training device facilitating an orientation of a performer's hands prior to a performing of a task, comprising:

first and second bracelets each configured to be worn on separate wrists of the performer, said first and second bracelets each including an annular band having a circumference configured to annularly embrace the selected wrist of the performer with a selectable degree of looseness, said first and second bracelets each having a plurality of spaced tubular rollers each having a hollow interior that loosely receives therein the respective annular band, each of said tubular rollers on each of said first and second bracelets being configured to separately rotate independent of other tubular rollers about an axis of the respective annular band to facilitate a tubular roller supported engagement of the bracelets with the performer's hands while moving onto and off from the performer's wrists; and a tethering device coupling the bracelets to one another.

2. The training device according to claim 1, wherein said annular bands are each made of an elastically stretchable and bendable material.

3. The training device according to claim 2, wherein the elastically stretchable and bendable material has a tubular configuration.

4. The training device according to claim 1, wherein the plurality of tubular rollers are made of an elastic material.

5. The training device according to claim 4, wherein the elastic material has an elastically compressible and bendable characteristic to accommodate the curvature of the exterior surface of the user's hands and wrists.

6. The training device according to claim 1, wherein the tethering device includes a clip directly connecting the annular bands together.

7. The training device according to claim 1, wherein the tethering device includes a first clip affixed to each annular band and a second clip affixed to each of said first clips.

8. The training device according to claim 7, wherein said second clip is an annular ring and wherein each said first clip has a hole receiving therein a segment of said annular ring.

9. The training device according to claim 1, wherein said tethering device includes a further annular band separate from said annular bands of said first and second bracelets, said further elastic band being made of an elastically stretchable and bendable material.

10. The training device according to claim 9, wherein said annular bands are each made of an elastically stretchable and bendable material.

11. A method of performing a task which requires (a) the hands of the performer to be oriented close together so that they can be used in concert followed shortly thereafter by (b) moving one hand independently of the other, the method comprising:

providing a training device having first and second tethered together bracelets, each bracelet having plural spaced rollers separately rotatably supported thereon;

placing a first bracelet onto a first wrist of the performer;

effecting a rotation of at least one roller on the first bracelet while placing the first bracelet onto the first wrist;

placing a second bracelet onto a second wrist of the performer;

effecting a rotation of at least one roller on the second bracelet while placing the second bracelet onto the second wrist;

performing the task which requires the hands of the user to be oriented close together so that they can be used in concert.

12. A method of performing a task according to claim 11, wherein the task to be performed is catching an object.

13. A method of performing a task according to claim 11, wherein subsequent to the performance of the task, one of said first and second bracelets is removed by the user in order to facilitate one hand moving independently of the other to perform a further task.

14. A method of performing a task according to claim 13, wherein the further task to be performed is grasping an object and manipulating the object using only one hand.

* * * * *